US012637622B2

(12) United States Patent
Touronen et al.

(10) Patent No.: US 12,637,622 B2
(45) Date of Patent: May 26, 2026

(54) PRODUCTION OF HYDROCARBONS FROM RECYCLED OR RENEWABLE ORGANIC MATERIAL

(71) Applicant: NESTE OYJ, Espoo (FI)

(72) Inventors: Jouni Touronen, Porvoo (FI); Kaisa Lamminpää, Porvoo (FI); Antti Pasanen, Porvoo (FI); Susanna Kuitunen, Porvoo (FI); Anna Zaitseva, Porvoo (FI)

(73) Assignee: NESTE OYJ, Espoo (FI)

( * ) Notice: Subject to any disclaimer, the term of this patent is extended or adjusted under 35 U.S.C. 154(b) by 674 days.

(21) Appl. No.: 17/261,754

(22) PCT Filed: Jul. 19, 2019

(86) PCT No.: PCT/EP2019/069497
§ 371 (c)(1),
(2) Date: Jan. 20, 2021

(87) PCT Pub. No.: WO2020/020771
PCT Pub. Date: Jan. 30, 2020

(65) Prior Publication Data

US 2021/0269722 A1 Sep. 2, 2021

(30) Foreign Application Priority Data

Jul. 20, 2018 (FI) ..... 20185653

(51) Int. Cl.
*C10G 3/00* (2006.01)
*C10G 1/00* (2006.01)
(Continued)

(52) U.S. Cl.
CPC ..... *C10G 3/50* (2013.01); *C10G 1/002* (2013.01); *C10G 3/42* (2013.01); *C10G 9/36* (2013.01);
(Continued)

(58) Field of Classification Search
CPC . C10G 3/42; C10G 3/50; C10G 21/16; C10G 1/06; C10G 1/002; C10G 11/00;
(Continued)

(56) References Cited

U.S. PATENT DOCUMENTS 2,524,088 A 10/1950 Shaw
3,503,866 A * 3/1970 Whitehead ..... C10G 1/002 208/418
(Continued)

FOREIGN PATENT DOCUMENTS

CA 894222 A 2/1972
CA 3035629 A1 4/2018
(Continued)

OTHER PUBLICATIONS

Energy Fossil, Recovery of Navy Distillate Fuel from Reclaimed Product, Dennis W. Brinkman & Marwin L. Whisman (Published Nov. 1984) .
(Continued)

*Primary Examiner* — Prem C Singh
*Assistant Examiner* — Brandi M Doyle
(74) *Attorney, Agent, or Firm* — Buchanan Ingersoll & Rooney PC

(57) ABSTRACT

A method is disclosed of producing hydrocarbons from a recycled or renewable organic material wherein the recycled or renewable organic material contains hydroxyaromatic hydrocarbon compounds. Exemplary methods include (a) providing recycled or renewable organic material; (b) optionally purifying the recycled or renewable organic material; (c) hydrotreating the recycled or renewable organic material in a presence of a hydrotreating catalyst, thereby forming a hydrocarbon stream and a phenol-containing effluent; (d) separating phenols from the phenol-containing effluent of step (c), thereby forming a phenol stream and a
(Continued)

purified water stream; and (e) recycling the phenol stream obtained in step (d) to step (c) to increase the yield of hydrocarbons obtained from step (c); to obtain hydrocarbons containing less than 1 wt % oxygen.

26 Claims, 5 Drawing Sheets

(51) Int. Cl.
*C10G 9/36* (2006.01)
*C10G 11/00* (2006.01)
*C10G 45/58* (2006.01)
*C10G 47/00* (2006.01)

(52) U.S. Cl.
CPC ..... *C10G 11/00* (2013.01); *C10G 45/58* (2013.01); *C10G 47/00* (2013.01); *C10G 2300/1003* (2013.01)

(58) Field of Classification Search
CPC ..... C10G 11/18; C10G 45/00; C10G 45/58; C10G 47/00; C10G 9/00; C10G 9/36; C10G 2300/1003; Y02P 30/20
See application file for complete search history.

(56) References Cited

U.S. PATENT DOCUMENTS 4,097,369 A 6/1978 Ebel et al.
4,151,072 A 4/1979 Johnson et al.
4,160,725 A 7/1979 Josis et al.
4,241,227 A 12/1980 Stonner et al.
4,252,637 A 2/1981 Knorre et al.
4,328,128 A 5/1982 Stanulonis et al.
4,400,553 A * 8/1983 Aneja ..... C02F 9/00 210/806
5,049,258 A 9/1991 Keim et al.
5,449,797 A 9/1995 Estes et al.
5,514,632 A 5/1996 Chester et al.
6,072,065 A 6/2000 Chavet
6,586,638 B1 7/2003 Zhang et al.
8,742,185 B2 * 6/2014 Ouni ..... C07C 5/27 585/734
9,347,178 B2 5/2016 Powell et al.
9,353,478 B2 5/2016 Powell et al.
9,382,483 B2 7/2016 Knuuttila et al.
9,399,836 B2 7/2016 Powell et al.
9,593,448 B2 3/2017 Powell et al.
9,663,720 B2 5/2017 Nousiainen et al.
9,688,919 B2 6/2017 Vilonen et al.
9,932,530 B2 4/2018 Garg et al.
10,023,810 B2 7/2018 Nousiainen et al.
10,815,428 B2 10/2020 Nousiainen et al.
2005/0101761 A1 5/2005 Lambert et al.
2005/0240065 A1 10/2005 Blaschke et al.
2006/0167291 A1 7/2006 Te et al.
2007/0170091 A1 7/2007 Monnier et al.
2008/0314799 A1 12/2008 Li et al.
2009/0229172 A1 9/2009 Brady et al.
2009/0250376 A1 10/2009 Brandvold et al.
2011/0138680 A1 6/2011 Dandeu et al.
2012/0088943 A1 4/2012 Knuuttila et al.
2012/0116134 A1 5/2012 Bozzano et al.
2013/0072730 A1 3/2013 Knuuttila et al.
2013/0090502 A1 4/2013 Laakkonen et al.
2013/0158329 A1 6/2013 Brandvold
2013/0305598 A1 11/2013 Hamilton et al.
2013/0345487 A1 * 12/2013 Baird ..... C10G 45/02 422/187
2014/0005451 A1 * 1/2014 Mezza ..... C10G 21/06 585/860
2014/0013658 A1 * 1/2014 Silverman ..... C12Y 604/01002 435/167
2014/0213836 A1 7/2014 Yao et al.
2014/0275666 A1 9/2014 Bauer et al.
2015/0052807 A1 2/2015 Nousiainen et al.
2015/0059354 A1 3/2015 Gutierrez et al.
2015/0251168 A1 9/2015 Kettunen et al.
2015/0361356 A1 12/2015 Garg et al.
2015/0376514 A1 * 12/2015 Yao ..... C10G 45/00 585/317
2016/0060540 A1 3/2016 Ouni et al.
2016/0130509 A1 5/2016 Nousiainen et al.
2016/0177188 A1 6/2016 Vilonen et al.
2016/0177201 A1 6/2016 Pandranki et al.
2016/0186067 A1 6/2016 Powell et al.
2016/0257888 A1 9/2016 Nousiainen et al.
2016/0289576 A1 10/2016 Eilos
2017/0145318 A1 5/2017 Myllyoja et al.
2017/0158967 A1 6/2017 Reiner et al.
2019/0203154 A1 7/2019 Malm
2020/0308505 A1 10/2020 Dayton et al.
2021/0277324 A1 9/2021 Toukoniitty et al.
2021/0284925 A1 9/2021 Gao et al.
2021/0292653 A1 9/2021 Touronen et al.
2021/0292656 A1 9/2021 Touronen et al.
2021/0292657 A1 9/2021 Toukoniitty et al.
2021/0301210 A1 9/2021 Timken et al.
2021/0332300 A1 10/2021 Timken
2022/0135891 A1 5/2022 Toukoniitty et al.

FOREIGN PATENT DOCUMENTS

CN 102102048 A 6/2011
CN 102504866 A 6/2012
CN 102786986 A 11/2012
CN 106552611 A 4/2017
CN 107636124 A 1/2018
CN 107892990 A 4/2018
CN 107974265 A 5/2018
CN 107974266 A 5/2018
CN 108251156 A 7/2018
EP 0072873 A1 3/1983
EP 0420651 A1 4/1991
EP 0420652 A1 4/1991
EP 0574272 A2 12/1993
EP 1396531 A2 3/2004
EP 2149593 A1 2/2010
EP 2930231 A1 10/2015
FI 20135638 A 12/2014
JP S5431484 B2 10/1979
JP 10940970 A 2/1997
JP H1161148 A 3/1999
JP 2000169862 A 6/2000
JP 2003034794 A 2/2003
JP 2003253038 A 9/2003
JP 2007224196 A 9/2007
JP 2009155475 A 7/2009
JP 2010509472 A 3/2010
JP 2011515539 A 5/2011
JP 2013544304 A 12/2013
SE 352373 B 12/1972
WO 2008058664 A1 5/2008
WO 2012069467 A1 5/2012
WO 2013089838 A1 6/2013
WO 2013156683 A1 10/2013
WO 2014001632 A1 1/2014
WO WO2014001633 * 1/2014
WO WO-2014001633 A1 * 1/2014 ..... C10G 3/44
WO 2015087938 A1 6/2015
WO 2015101713 A1 7/2015
WO 2016053948 A1 4/2016
WO 2018024728 A1 2/2018
WO 2018025103 A1 2/2018
WO 2018025104 A1 2/2018
WO 2018058172 A1 4/2018
WO 2018127812 A1 7/2018

(56) References Cited

OTHER PUBLICATIONS

Fats and Oils: Formulating and Processing for Applications, Third Edition by Richard D. O'Brien (2009).
Finnish Office Action dated Apr. 23, 2019 for Application No. 2185650.
International Preliminary Report on Patentability issued in corresponding International Patent Application No. PCT/EP2019/069474 dated Dec. 15, 2020.
International Preliminary Report on Patentability issued in corresponding International Patent Application No. PCT/EP2019/069482 dated Jan. 21, 2021.
International Preliminary Report on Patentability issued in corresponding International Patent Application No. PCT/EP2019/069490 dated Jul. 15, 2020.
International Preliminary Report on Patentability issued in corresponding International Patent Application No. PCT/EP2019/069497 dated Oct. 9, 2020.
International Preliminary Report on Patentability issued in corresponding International Patent Application No. PCT/EP2019/069503 dated Sep. 20, 2020.
International Preliminary Report on Patentability issued in corresponding International Patent Application No. PCT/EP2019/069512 dated Sep. 20, 2020.
International Search Report (PCT/ISA/210) and Written Opinion (PCT/ISA/237) mailed on Dec. 19, 2019, by the European Patent Office as the International Searching Authority for International Application No. PCT/EP2019/069503.
International Search Report (PCT/ISA/210) and Written Opinion (PCT/ISA/237) mailed on Dec. 5, 2019, by the European Patent Office as the International Searching Authority for International Application No. PCT/EP2019/069474.
International Search Report (PCT/ISA/210) and Written Opinion (PCT/ISA/237) mailed on Nov. 12, 2019, by the European Patent Office as the International Search Authority for International Patent Application No. PCT/EP2019/069482.
International Search Report (PCT/ISA/210) and Written Opinion (PCT/ISA/237) mailed on Sep. 10, 2019, by the European Patent Office as the International Searching Authority for International Application No. PCT/EP2019/069497.
International Search Report (PCT/ISA/210) and Written Opinion (PCT/ISA/237) mailed on Sep. 10, 2019, by the European Patent Office as the International Searching Authority for International Application No. PCT/EP2019/069512.
International Search Report (PCT/ISA/210) with translation and Written Opinion (PCT/ISA/237) mailed on Nov. 12, 2019, by the European Patent Office as the International Searching Authority for International Application No. PCT/EP2019/069490.
Punkkinen Henna et al., Research Report: "Thermal conversion of plastic-containing waste: A Review" (2017).
Search Report mailed on Apr. 9, 2019 by the Finnish Patent and Registration Office for U.S. Appl. No. 20/185,651.
Search Report mailed on Nov. 12, 2018 by the Finnish Patent and Registration Office for U.S. Appl. No. 20/185,651.
Search Report mailed on Nov. 19, 2018 by the Finnish Patent and Registration Office for U.S. Appl. No. 20/185,653.
Search Report mailed on Nov. 20, 2018 by the Finnish Patent and Registration Office for U.S. Appl. No. 20/185,654.
Search Report mailed on Nov. 21, 2018 by the Finnish Patent and Registration Office for U.S. Appl. No. 20/185,655.
Search Report mailed on Nov. 21, 2018 by the Finnish Patent and Registration Office for Application No. 2185650.
Search Report mailed on Nov. 6, 2018 by the Finnish Patent and Registration Office for U.S. Appl. No. 20/185,652.
Mohd Zin, Rohani Binti, et al., "Process Design in Degumming and Bleaching of Palm Oil", Centre of Lipids Engineering and Applied Research (CLEAR), Universiti Teknologi Malaysia, Nov. 2006, 239 pages.
Pyl, Steven P., et al., "Wood-derived olefins by steam cracking of hydrodeoxygenated tall oils", Bioresource Technology 126, 2012, pp. 48-55, Elsevier Ltd.
Sigot, L., et al., "Adsorption of octamethylcyclotetrasiloxane on silica gel for biogas purification", Fuel, Jul. 8, 2014, vol. 135, pp. 205-209.
Vogt, E.T.C., et al., "Fluid catalytic cracking: recent developments on the grand old lady of zeolite catalysis", Chem. Soc. Rev., Sep. 18, 2015, pp. 7342-7370, The Royal Society of Chemistry.
First Office Action dated Feb. 15, 2022, issued in the corresponding Chinese Patent Application No. 2019800477596, 15 pages including 6 pages of English Translation.
Search Report dated Mar. 24, 2022, issued in the corresponding Chinese Patent Application No. 2019800538354, 3 pages of official copy without English Translation.
Office Action dated Mar. 1, 2022, issued in the corresponding Japanese Patent Application No. 2021-502416, 4 bages including 2 pages of English Translation.
Office Action dated Mar. 1, 2022, issued in the corresponding Japanese Patent Application No. 2021-502417, 10 bages including 6 pages of English Translation.
Office Action dated Mar. 1, 2022, issued in the corresponding Japanese Patent Application No. 2021-502426, 5 bages including 3 pages of English Translation.
Office Action dated Mar. 8, 2022, issued in the corresponding Japanese Patent Application No. 2021-502928, 8 bages including 5 pages of English Translation.
Office Action (Communication) issued on Mar. 30, 2022, by the European Patent Office in corresponding European Patent Application No. 19742575.4. (8 pages).
Office Action (Opposition) issued on Dec. 15, 2021, by the Finnish Patent Office in corresponding Finnish Patent Application No. FI 128911. (34pages).
Office Action issued on Mar. 17, 2022, by the U.S. Patent Office in corresponding U.S. Appl. No. 17/261,679.
First Office Action issued on Feb. 15, 2022, by the Chinese Patent Office in corresponding Chinese Patent Application No. 2019800484072, and an English Translation of the Office Action. (18 pages).
Notification of the First Office Action issued on Apr. 25, 2023, by the Chinese Patent Office in corresponding Chinese Patent Application No. 201980053799.1, and an English Translation of the Office Action. (21 pages).

* cited by examiner

PRODUCTION OF HYDROCARBONS FROM RECYCLED OR RENEWABLE ORGANIC MATERIAL

FIELD OF THE INVENTION

The present invention relates to a method of producing hydrocarbons from a recycled or renewable organic material, in particular recycled or renewable organic material comprising hydroxyaromatic hydrocarbon compounds.

BACKGROUND OF THE INVENTION

In some cases recycled or renewable organic material contains organic high amounts of complex organic molecules that degrade to phenol derivatives when subjected to hydrotreatment processes. For example tall oil pitch (TOP) contains high amounts of sterols. In a hydrotreatment process, such as hydrodeoxygenation (HDO), the sterols degrade to, among others, low molar weight phenol and alkylphenols. The alkylphenols and phenol are water soluble and end up into the waste water stream reducing the potential hydrocarbon yield from the process. Phenol yield from the hydrotreatment of TOP can be as high as 1 kg/ton of TOP. Such high yield of phenols is challenging for a waste water treatment plant because phenols are poisonous for a biological treatment. Therefore a strategy to handle the produced phenols is required.

BRIEF DESCRIPTION OF THE INVENTION

An object of the present invention is thus to provide a method so as to overcome the above problems. The objects of the invention are achieved by a method which is characterized by what is stated in the independent claims. The preferred embodiments of the invention are disclosed in the dependent claims.

The invention is based on the surprising realization recycled or renewable organic material containing high amounts of hydroxyaromatic hydrocarbon compounds, such as phenolic compounds, may be used to produce hydrocarbons from recycled or renewable organic material while minimizing the amount of phenols in waste water by separating phenols from the phenol-containing effluent obtained from a hydrotreatment step and recycling said phenol stream back to hydrotreatment step simultaneously increasing the yield of obtained hydrocarbons.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
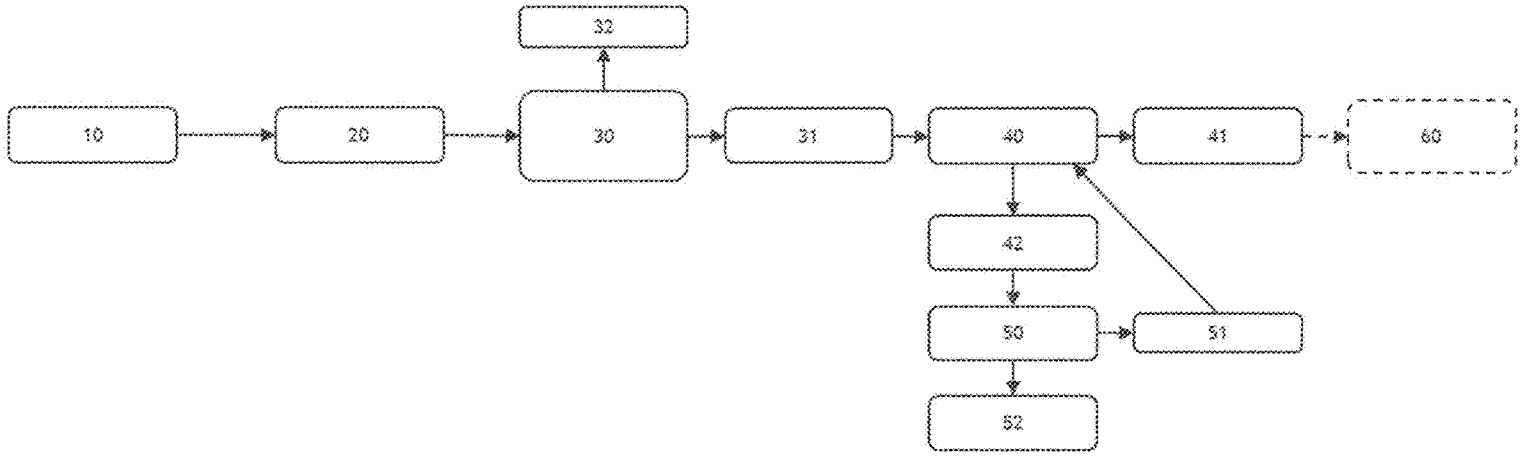
FIG. 1 illustrates a first exemplary process flow of the present method.

The present invention provides a method of producing hydrocarbons from recycled or renewable organic material.

The term "recycled or renewable organic material" refers to organic material, i.e. material containing carbon, obtained 1) from a natural resource which replenishes to overcome recourse depletion caused by its usage and consumption or 2) from a raw or processed material that is recovered from a waste for reuse. The recycled or renewable organic material characteristically comprises aliphatic compounds having a carbon chain of from 4 to 30 carbon atoms, particularly from 12 to 22 carbon atoms. Typical examples of such aliphatic compounds are fatty acids or esters thereof, in particular wherein the fatty acids have an aliphatic chain of from 4 to 30 carbon atoms, more particularly from 12 to 22 carbon atoms. The recycled or renewable organic material typically comprises at least 50 wt % aliphatic compound of the total weight of the recycled or renewable organic material.

Typically the recycled or renewable organic material refers to fats and/or oils of plant, microbial, algal, and/or animal origin. It also refers to any waste stream received from processing of such oils and/or fats. The recycled or renewable organic material may be in an unprocessed form (e.g. animal fat), or a processed form (used cooking oil). The recycled or renewable organic material also refers to fossil waste-based oils and waste oils.

The term "plant based fats and oils" refers to fat and/or oils of plant origin i.e. oils that can originate directly from plants or can be byproducts from various industrial sectors, such as agriculture or forest industry.

Examples of plant based fats and oils of the present invention include, but are not limited to, sludge palm oil, rapeseed oil, canola oil, colza oil, sunflower oil, soybean oil, hemp oil, olive oil, linseed oil, cottonseed oil, mustard oil, palm oil, *arachis* oil, castor oil and coconut oil.

Other examples of plant based fats and oils include biocrudes and bio oils. Biocrudes and bio oils are produced from biomass, in particular from lignocellulosic biomass, with various liquefying methods, such as hydrothermal liquefaction, or pyrolysis, in particular fast pyrolysis.

The term "biocrude" refers to oils produced from biomass by employing hydrothermal liquefaction. The term "bio oil" refers to pyrolysis oils produced from biomass by employing pyrolysis. The term "biomass" refers to material derived from recently living organisms, which includes plants, animals and their byproducts. The term "lignocellulosic biomass" refers to biomass derived from plants or their byproducts. Lignocellulosic biomass is composed of carbohydrate polymers (cellulose, hemicellulose) and an aromatic polymer (lignin).

The term "pyrolysis" refers to thermal decomposition of materials at elevated temperatures in a non-oxidative atmosphere. The term "fast pyrolysis" refers to thermochemical decomposition of biomass through rapid heating in absence of oxygen. The term "hydrothermal liquefaction" (HTL) refers to a thermal depolymerization process used to convert wet biomass into crude-like oil under moderate temperature and high pressure.

Examples of bio oil and biocrude produced from lignocellulosic biomass, e.g. materials like forest harvesting residues or byproducts of a saw mill, are lignocellulosic pyrolysis liquid (LPL), produced by employing fast pyrolysis, and HTL-biocrude, produced by employing hydrothermal liquefaction.

Further examples of plant based fats and oils include crude tall oil (CTO), obtained as a by-product of the Kraft process (wood pulping), and its derivatives, such as tall oil pitch (TOP), crude fatty acid (CFA), tall oil fatty acid (TOFA) and distilled tall oil (DTO).

Crude tall oil comprises resin acids, fatty acids, and unsaponifiables. Resin acids are a mixture of organic acids derived from oxidation and polymerization reactions of terpenes. The main resin acid in crude tall oil is abietic acid but abietic derivatives and other acids, such as primaric acid are also found. Fatty acids are long chain monocarboxylic acids and are found in hardwoods and softwoods. The main fatty acids in crude tall oil are oleic, linoleic and palmitic acids. Unsaponifiables cannot be turned into soaps as they are neutral compounds which do not react with sodium hydroxide to form salts. They include sterols, higher alcohols and hydrocarbons. Sterols are steroids derivatives which also include a hydroxyl group.

The term "tall oil pitch (TOP)" refers to residual bottom fraction from crude tall oil (CTO) distillation processes. Tall oil pitch typically comprises from 34 to 51 wt % free acids, from 23 to 37 wt % esterified acids, and from 25 to 34 wt % unsaponifiable neutral compounds of the total weight of the tall oil pitch. The free acids are typically selected from a group consisting of dehydroabietic acid, abietic and other resin acids. The esterified acids are typically selected from a group consisting of oleic and linoleic acids. The unsaponifiables neutral compounds are typically selected from a group consisting of diterpene sterols, fatty alcohols, sterols, and dehydrated sterols.

The term "crude fatty acid (CFA)" refers to fatty acid-containing materials obtainable by purification (e.g., distillation under reduced pressure, extraction, and/or crystallization) of CTO.

The term "tall oil fatty acid (TOFA)" refers to fatty acid rich fraction of crude tall oil (CTO) distillation processes. TOFA typically comprises mainly fatty acids, typically at least 80 wt % of the total weight of the TOFA. Typically TOFA comprises less than 10 wt % rosin acids.

The term "distilled tall oil (DTO)" refers to resin acid rich fraction of crude tall oil (CTO) distillation processes. DTO typically comprises mainly fatty acids, typically from 55 to 90 wt %, and rosin acids, typically from 10 to 40 wt % rosin acids, of the total weight of the DTO. Typically DTO comprises less than 10 wt % unsaponifiable neutral compounds of the total weight of the distilled tall oil.

The term "animal based fats and oils" refers to fats and/or oils of animal origin i.e lipid materials derived from animals. Examples of animal based fats and oils include, but are not limited to, such as suet, tallow, blubber, lard, train oil, milk fat, fish oil, poultry oil and poultry fat.

The term "microbial oils" refers to triglycerides (lipids) produced by microbes.

The term "algal oils" refers to oils derived directly from algae.

The term "fossil waste-based oils" refers to oils produced from waste streams like waste plastics or end-life-tires. Examples of fossil waste-based oils include waste plastic pyrolysis oil (WPPO) and end-life-tire pyrolysis oil (ELTPO).

The term "waste oils" refers to any oils that, through contamination, have become unsuitable for their original purpose due to the presence of impurities or loss of original properties. Examples of waste oils are used lubricant oils (ULO), hydraulic oils, transformer oils or oils used in metal working.

In the present invention the recycled or renewable organic material is typically selected from a group consisting of plant based fats and oils, animal based fats and oils, fossil waste-based oils, waste oils, algal oils and microbial oils.

Particular examples of the recycled or renewable organic material of the present invention include, but are not limited to, animal based fats and oils, such as suet, tallow, blubber, lard, train oil, milk fat, fish oil, poultry oil, and poultry fat; plant based fats and oils, such as sludge palm oil, rapeseed oil, canola oil, colza oil, sunflower oil, soybean oil, hemp oil, olive oil, linseed oil, cottonseed oil, mustard oil, palm oil, *arachis* oil, castor oil, coconut oil, lignocellulosic pyrolysis liquid (LPL), HTL biocrude, crude tall oil (CTO), tall oil pitch (TOP), crude fatty acid (CFA), tall oil fatty acid (TOFA) and distilled tall oil (DTO); microbial oils; algal oils; recycled fats or various waste streams of the food industry, such as used cooking oil, yellow and brown greases; free fatty acids, any lipids containing phosphorous and/or metals, oils originating from yeast or mold products, recycled alimentary fats; starting materials produced by genetic engineering, and any mixtures of said feedstocks.

In an example of the present invention the recycled or renewable organic material is selected from a group consisting of lignocellulosic biomass based oils such as lignocellulose pyrolysis liquid (LPL) and HTL-biocrude; crude tall oil and its derivatives; such as tall oil pitch (TOP), tall oil fatty acid (TOFA), distilled tall oil (DTO) and, crude fatty acid (CFA); sterol containing fats, such as animal fats; preferably the recycled or renewable organic material is crude tall oil (CTO) or tall oil pitch (TOP).

In another example of the present invention the recycled or renewable organic material is selected from a group consisting of tall oil, tall oil distillation derivates, such as tall oil pitch (TOP), crude fatty acid (CFA), tall oil fatty acid (TOFA), distilled tall oil (DTO), and pyrolysis oils, such as hydrothermal liquefaction oils (HTL) and lignocellulose pyrolysis oils; more particularly the recycled or renewable organic material is tall oil pitch (TOP).

The recycled or renewable organic material to be treated by the present method contains high amounts hydroxyaromatic hydrocarbon compounds. Examples of such hydroxyaromatic hydrocarbon compounds include plant based hydroxyaromatic hydrocarbon compounds such as sterols, lignin, and phenolic lipids such as cardanol. Further examples of hydroxyaromatic hydrocarbon compounds include animal fat based hydroxyaromatic hydrocarbon compounds such as sterols. The recycled or renewable organic material of the present invention comprises more than 0.01 wt % hydroxyaromatic hydrocarbon compounds. In particular the recycled or renewable organic material of the present invention comprises more than 0.05 wt % hydroxyaromatic hydrocarbon compounds, more particularly the recycled or renewable organic material of the present invention comprises more than 0.1 wt % hydroxyaromatic hydrocarbon compounds, and even more particularly the recycled or renewable organic material of the present invention comprises more than 0.5 wt % hydroxyaromatic hydrocarbon compounds of the total weight of the recycled or renewable organic material.

The recycled or renewable organic material to be treated by the present method may also comprise further impurities e.g. impurities comprising phosphorus and/or metals in the form of phospholipids, soaps and/or salts. The impurities may for example be in the form of phosphates or sulfates, iron salts or organic salts, soaps or phospholipids. The metal impurities that may be present in the biomass-based lipid material are for example alkali metals or alkali earth metals, such as sodium or potassium salts, or magnesium or calcium salts, or any compounds of said metals.

Accordingly provided herein is a method of producing hydrocarbons from recycled or renewable organic material wherein the recycled or renewable organic material comprises hydroxyaromatic hydrocarbon compounds, comprising the steps of (a) providing recycled or renewable organic material;

(b) optionally purifying the recycled or renewable organic material; and (c) hydrotreating the recycled or renewable organic material in a presence of a hydrotreating catalyst, thereby forming a hydrocarbon stream and a phenol containing effluent; and (d) separating phenols from the phenol containing effluent of step (c), thereby forming a phenol stream and a purified water stream; and (e) recycling the phenol stream obtained in step (d) to step (c) to increase the yield of hydrocarbons obtained from step (c);

to obtain hydrocarbons comprising less than 1 wt % oxygen.

In step (b) the recycled or renewable organic material is optionally purified to remove undesired impurities, such as phosphorous and/or silicon, from the recycled or renewable organic material. The purification step (b) may be accomplished by heat treating or bleaching the recycled or renewable organic material or by any other method found suitable by a skilled person for purifying recycled or renewable organic material.

The recycled or renewable organic material is subjected to hydrotreatment in a presence of a hydrotreating catalyst, optionally after the purification step (b).

The term "hydrotreating" refers to a chemical engineer process in which reaction of hydrogen is used to remove impurities, such as oxygen, sulphur, nitrogen, phosphorous, silicon and metals, especially as part of oil refining.

Hydrotreating can be performed in one or several steps in one or more reactor units or catalyst beds.

Step (c) is typically achieved under continuous hydrogen flow. For achieving optimal results the continuous hydrogen flow is step (c) preferably has H2/feed ratio from 500 to 2000 n-L/L, more preferably from 800 to 1400 n-L/L.

In step (c) hydrotreatment is advantageously performed at a temperature from 270 to 380° C., preferably from 275 to 360° C., more preferably from 300 to 350° C. Typically the pressure in step (c) is from 4 to 20 MPa.

The hydrotreatment catalyst is step (c) preferably comprises at least one component selected from IUPAC group 6, 8 or 10 of the Periodic Table. Preferably the hydrotreating catalyst in step (c) is a supported Pd, Pt, Ni, NiW, NiMo or a CoMo catalysts and the support is zeolite, zeolite-alumina, alumina and/or silica, preferably $NiW/Al_2O_3$, $NiMo/Al_2O_3$ or $CoMo/Al_2O_3$. In particular the hydrotreating catalyst is a sulphided NiW, NiMO or CoMo catalyst.

The time during which the recycled or renewable organic material is heated and held at the desired temperature, i.e. residence time, is typically from 1 to 300 min, preferably from 5 to 240 min, more preferably from 30 to 90 min in step (c).

An applicable hydrotreatment step (c) provides a purified hydrotreated recycled or renewable organic material. The purified hydrotreated recycled or renewable organic material advantageously comprises less than 50% of the chlorine content of the recycled or renewable organic material provided in step (a).

For achieving optimal results part of the hydrotreated recycled or renewable organic material may be recycled in step (c). Preferably the ratio of the fresh feed i.e. purified recycled or renewable organic material obtained in step (b) to the recycled hydrotreated recycled or renewable organic material is from 2:1 to 20:1.

In a particular example step (c) is accomplished by (c1) hydrodeoxygenating (HDO) the recycled or renewable organic material. This is preferably achieved in a presence of a HDO catalyst. Preferably this is achieved at a presence of a HDO catalyst at a temperature from 290 to 350° C. under pressure from 4 to 20 MPa and under continuous hydrogen flow.

The term "hydrodeoxygenation (HDO)" refers to removal of oxygen as water by the means of molecular hydrogen under the influence of a (HDO) catalyst.

The HDO catalyst may for example be selected from a group consisting of NiMO-, CoMo-, NiW-catalysts and any mixtures thereof. Preferably the HDO catalyst is sulphided NiW, NiMo or CoMo catalyst.

Advantageously, the continuous hydrogen flow has H2/feed ratio from 500 to 2000 n-L/L, preferably from 800 to 1400 n-L/L.

Preferably step (c1) is performed to obtain hydrodeoxygenated recycled or renewable organic material comprising less than 1 wt % oxygen.

For achieving optimal results part of the deoxygenated recycled or renewable organic material may be recycled in step (c). Preferably the ratio of the fresh feed i.e. purified recycled or renewable organic material obtained in step (b) to the recycled deoxygenated recycled or renewable organic material is from 2:1 to 20:1.

In another example step (c) is accomplished by (c2) hydrodesulfurizing (HSD) the heat treated recycled or renewable organic material fraction. The term "hydrodesulfurisation (HDS)" refers to removal of sulfur as hydrogensulfide by the means of molecular hydrogen under the influence of a (HDS) catalyst.

In another example step (c) is accomplished by (c3) hydrometaillizing (HDM) the heat treated recycled or renewable organic material fraction. The term "hydrodemetallization (HDM)" refers to removal of metals by trapping them with a (HDM) catalyst.

In another example step (c) is accomplished by (c4) hydrodenitrificating (HDN) the heat treated recycled or renewable organic material fraction. The term "hydrodenitrification (HDN)" refers to removal of nitrogen by the means of molecular hydrogen under the influence of a (HDN) catalyst.

In another example step (c) is accomplished by (c5) hydrodearomatizing (HDA) the heat treated recycled or renewable organic material fraction. The term "hydrodearomatisation (HDA)" refers to saturation or ring opening of aromatics by the means of molecular hydrogen under the influence of a (HDA) catalyst.

In step (d) phenols are separated from the phenol containing effluent thereby forming a phenol stream and a purified water stream.

Step (d) may be accomplished by any viable physical separation method found suitable by a skilled person for separation phenol from an aqueous phase. Suitable examples include, but are not limited to stripping and liquid-liquid extraction. Preferably step (d) is accomplished by liquid-liquid extraction or stripping.

For an example (d1) the phenols are separated from the phenol containing effluent by liquid-liquid extraction with a non-aromatic organic solvent that is sparingly soluble to water. Preferably the non-aromatic organic solvent is selected from a group consisting of mesityl oxide, methyl isobutyl ketone, methyl tert-butyl ketone, methyl tert-butyl ether, methyl isopropyl ketone, 3-heptanone, 2-hexanone and mixtures thereof. More preferably the non-aromatic organic solvent is methyl isobutyl ketone.

Step (d1) takes place at any temperature from 30 to 50° C. and is performed under pressure from 100 to 200 kPa.

For another example (d2) the phenols are separated from the phenol containing effluent by stream stripping the phenol containing effluent to obtain a phenol stream and a purified water stream.

Step (d2) takes place at any temperature from 102 to 135° C. and is performed under pressure from 100 to 300 kPa.

After separation in step (d) the phenol stream is recycled to the hydrodeoxygenation step (c) wherein it is converted to benzene and alkylbenzenes and other cracking products under the prevailing conditions. This increases the hydrocarbon yield of the hydrotreatment process.

FIG. 1 illustrates a first exemplary process flow of the present method.

Referring to FIG. 1, a feed of recycled or renewable organic material, in particular tall oil pitch (TOP), 10 is optionally subjected to a step of heat treating 20 the recycled or renewable organic material as discussed herein for step (b1). The heat treated feed of recycled or renewable organic material is then evaporated 30 as discussed herein for step (b1) and a bottom containing a heat treated recycled or renewable organic material fraction 31 comprising less than 50% of the original silicon content of the recycled or renewable organic material provided in step (a), and a vapor fraction 32 comprising the major part of volatile undesired impurities is obtained. The heat treated recycled or renewable organic material is then subjected to hydrotreatment 40, as discussed herein for step (c) to obtain a hydrocarbon stream 41 and a phenol containing effluent 42. The phenol containing effluent is then subjected to separating 50 phenols from the phenol-containing effluent of step (d), thereby forming a phenol stream 51 and a purified water stream 52 as discussed herein for step (d); and the phenol stream obtained in step (d) is then recycled to hydrotreatment 40 as discussed herein for step (e). The purified recycled or renewable organic material 41 may then be subjected to catalytic upgrading 60.

Figure 2:
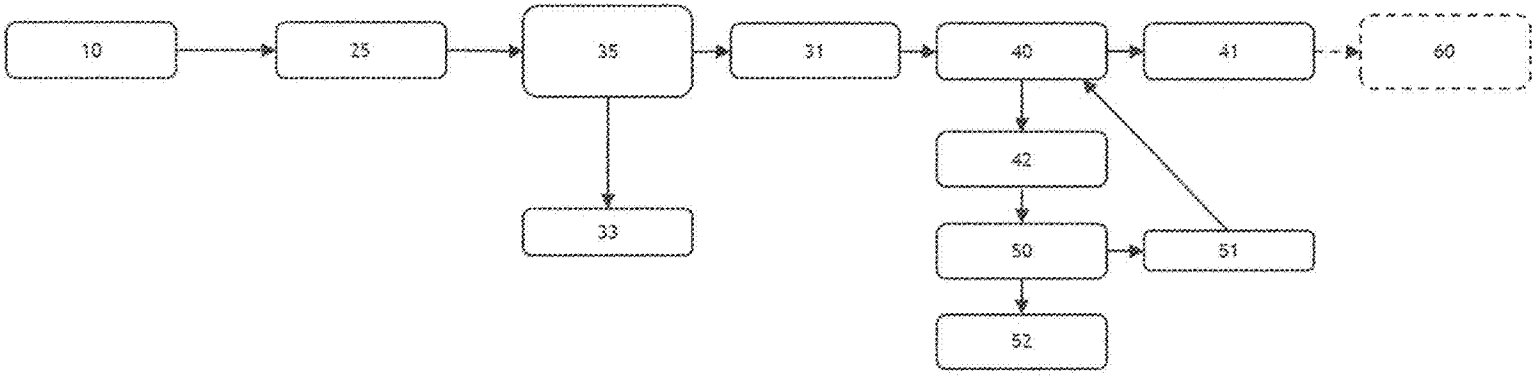
FIG. 2 illustrates a second exemplary process flow of the present method.

FIG. 2 illustrates a second exemplary process flow of the present method.

Referring to FIG. 2, a feed of recycled or renewable organic material, in particular tall oil pitch (TOP), 10 is optionally subjected to a step of heat treating 25 the recycled or renewable organic material in a presence of an adsorbent as discussed herein for step (b2). The adsorbent is then separated 35 from the heat treated feed of recycled or renewable organic material as discussed herein for step (b2) and a heat treated recycled or renewable organic material fraction 31 comprising less than 50% of the original silicon content of the recycled or renewable organic material provided in step (a), and the adsorbent 33 comprising the major part of undesired impurities is obtained. The heat treated recycled or renewable organic material is then subjected to hydrotreatment 40, as discussed herein for step (c) to obtain a hydrocarbon stream 41 and a phenol containing effluent 42. The phenol containing effluent is then subjected to separating 50 phenols from the phenol-containing effluent of step (d), thereby forming a phenol stream 51 and a purified water stream 52 as discussed herein for step (d); and the phenol stream obtained in step (d) is then recycled to hydrotreatment 40 as discussed herein for step (e). The purified recycled or renewable organic material 41 may then be subjected to catalytic upgrading 60.

After hydrocarbons have been produced in accordance with the present method, it may be subjected to further processing e.g. catalytic upgrading. Such catalytic upgrading processes include, but are not limited to, catalytic cracking, catalytic hydrocracking, thermo-catalytic cracking, catalytic hydrotreatment, fluid catalytic cracking, catalytic ketonization, and catalytic esterification. Such processes require the recycled or renewable organic material to be sufficiently pure and free from impurities that may otherwise hamper the catalytic process or poison the catalyst (s) present in the process.

Accordingly the present invention further provides a process for producing recycled or renewable hydrocarbons, comprising steps of (x) purifying the recycled or renewable organic material as discussed herein, and (y) subjecting the purified recycled or renewable organic material to an oil refinery conversion process, wherein the oil refinery conversion process comprises altering the molecular weight of the feed, such hydrocracking, or steamcracking, removal of heteroatoms from the feed, such as thermal catalytic cracking, fluid catalytic cracking, or hydrotreating, in particular hydrodeoxygenating, or hydrodesulfurizing, altering the degree of saturation of the feed, such as hydrotreating, thermal catalytic cracking, or fluid catalytic cracking, rearranging the molecular structure of the feed, such as isomerizing, or any combination thereof to obtain at least one recycled or renewable hydrocarbon.

In a typical example of the present process the recycled or renewable hydrocarbon is a renewable traffic fuel or fuel component.

In an example of the present process, step (y) is hydrocracking. In such example, step (y) is preferably performed in a mild hydrocracking (MHC) refinery unit, in particular in a presence of a hydrocracking catalyst.

In another example of the present process, step (y) is steamcracking. In such example step (y) is preferably performed in a steamcracking unit.

In yet another example of the present process, step (y) is isomerization. In such example, step (y) is preferably performed in an isomerization unit.

In yet another example of the present process, step (y) is hydrotreating. In such example, step (y) is preferably performed in a hydrotreating unit.

In yet another example of the present process, step (y) is thermal catalytic cracking (TCC). In such example, step (y) is preferably performed in a thermal catalytic cracking unit.

In yet another example of the present process, step (y) is fluid catalytic cracking (FCC). In such example, step (y) is preferably performed in a fluid catalytic cracking unit.

EXAMPLES

Figure 3:
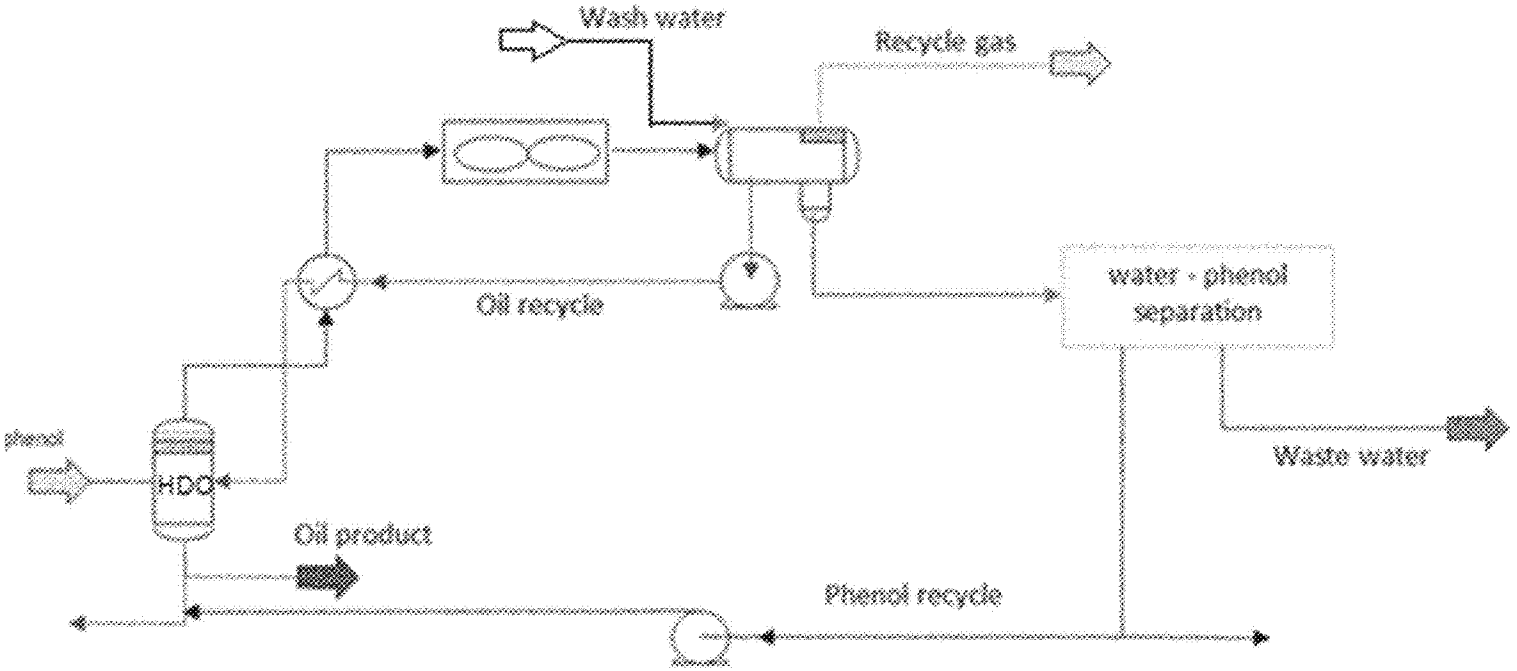
FIG. 3 is scheme for the separation of waste water in a HDO process.

The test simulations were made to provide preliminary estimates for the cost of the phenol separation process. The waste water stream from FIG. 3 is considered in the simulation and the update of other streams shown in FIG. 3 is provided for the process with the phenol stream recycling.

Figure 4:
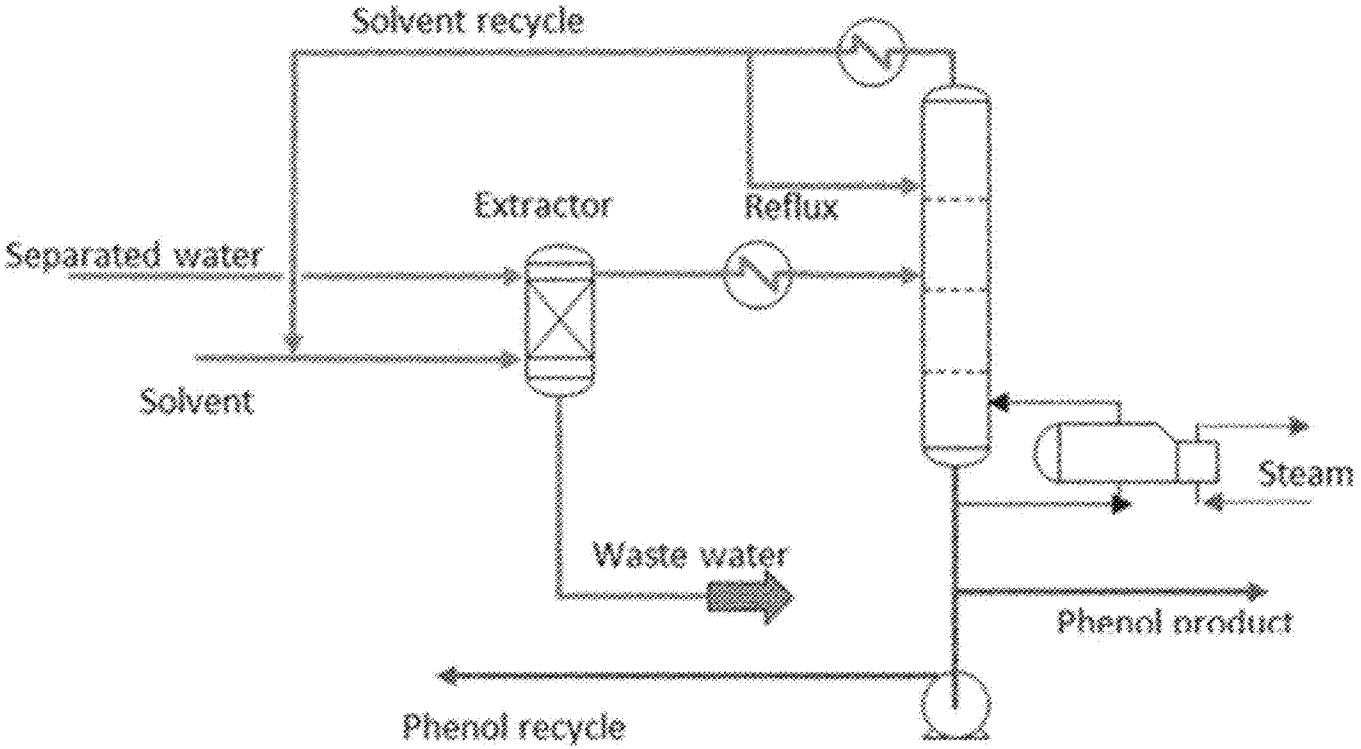
FIG. 4 is scheme of an extractive phenol separation process.

For extraction process (FIG. 4) the simulation is done for a 40 C extraction process and the solvent recycle distillation at 1 bar. The conditions could be optimized in future, because there is overpressure in the feed water stream and the phenol recycle should be pressurized for the recycling to the reactor. The considered process is based on methyl isobutyl ketone solvent, which demonstrates very high selectivity towards phenol extraction.

Figure 5:
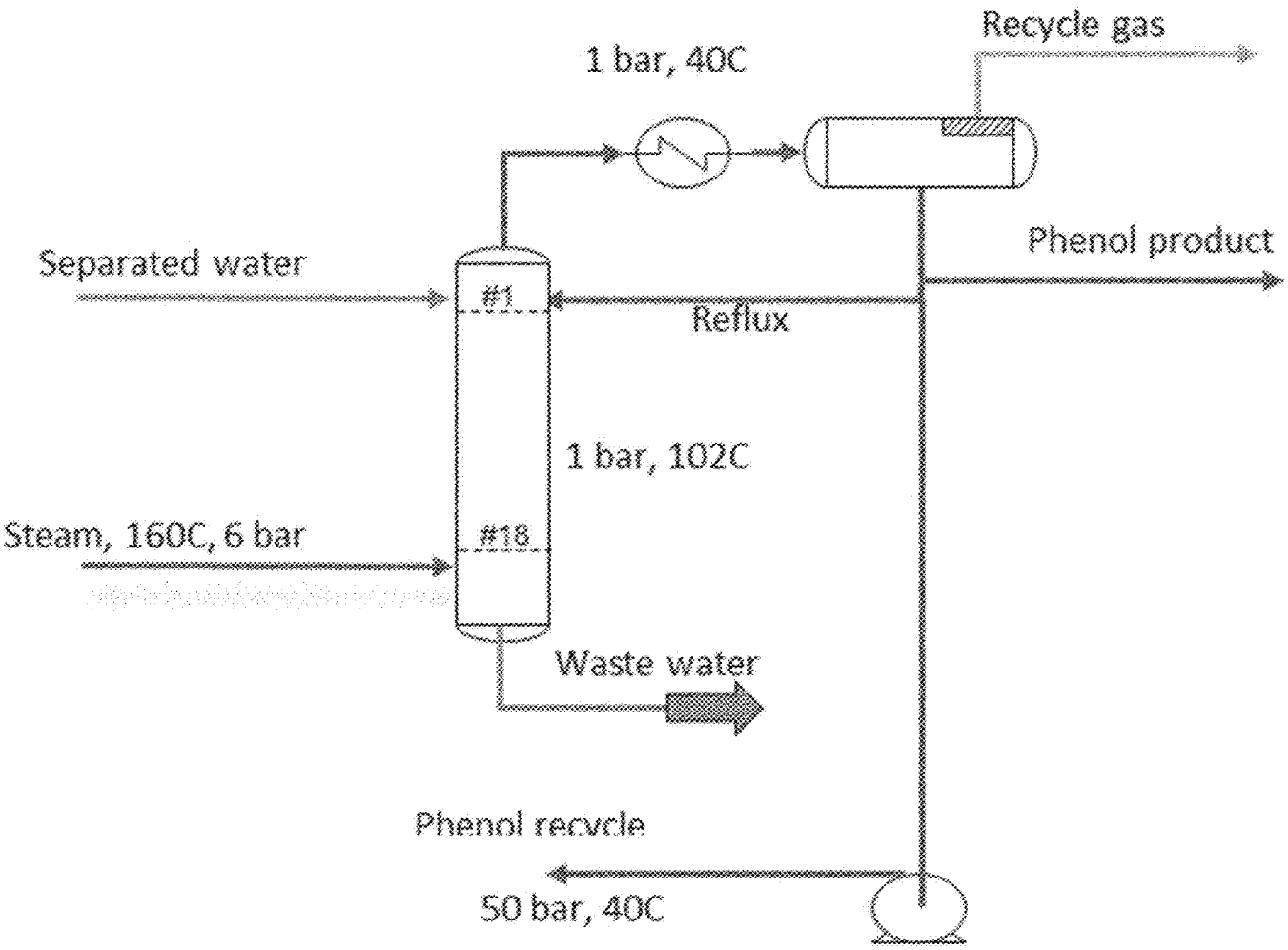
FIG. 5 is a scheme of the stripping phenol separation.

The stripping column (FIG. 5) is simulated at atmospheric pressure.

The water flow from the HDO unit is 5 bar and 40 C, thus 2 bar pressure is also possible to utilize in the column. The heating is unavoidable for the stripping column that operates at 100, but heat of the oil from HDO unit can be used for the energy integration. If the waste water satisfies 1 ppmw phenol specification, considerable amount of water is recycled to the reactor (see Table 2). Thus, about 15 kW is needed for the recycle flow pressurization to the reactor pressure.

TABLE 1

Comparison of the phenol separation processes; phenol stripping and phenol extraction. Phenol flow rates.

| Case | Recycle + phenol conversion | Phenol recycled kg/h | Phenol in rec. Oil kg/h | phenol in sour gas kg/h | Phenol in oil product kg/h | phenol in waste water kg/h | Phenol in waste water ppmw | Benzene yield kg/h |
|---|---|---|---|---|---|---|---|---|
| Dist A0 | No | 6.6 | 8 | 0.2 | 2.3 | 0.002 | 0.94 | — |
| Dist A1 | Yes, 50% | 8.3 | 9.2 | 0.17 | 2.6 | 0.97 | 304 | 4.1 |
| Dist A2 | Yes, 50% | 10.4 | 9.2 | 0.1 | 2.6 | 0.007 | 1.06 | 5.2 |
| Dist B1 | Yes, 80% | 7.3 | 8 | 0.15 | 2.3 | 0.82 | 256.3 | 5.8 |
| Dist B2 | Yes, 80% | 8.8 | 7.7 | 0.09 | 2.2 | 0.007 | 1.1 | 7 |
| Ext C0 | No | 6.6 | 8 | 0.2 | 2.3 | 6E−07 | 4E−04 | — |
| Ext C1 | Yes, 50% | 11.5 | 8 | 1.13 | 2.3 | 3E−07 | 2E−04 | 5.7 |
| Ext C2 | Yes, 50% | 12.4 | 7.5 | 1.2 | 2.1 | 2E−06 | 1E−03 | 6.2 |
| Ext D1 | Yes, 80% | 9.8 | 6.5 | 1 | 1.8 | 2E−06 | 1E−03 | 7.8 |
| Ext D2 | Yes, 80% | 10.2 | 6.2 | 1 | 1.8 | 7E−07 | 5E−04 | |

TABLE 2

Comparison of the phenol separation processes; phenol stripping and phenol extraction. Energy characteristics.

| | Recycle + phenol conversion | Energy of condenser kW | water to reactor/solvent makeup kg/h | Steam rate kg/h | Steam energy kW |
|---|---|---|---|---|---|
| Dist A0 | No | 1117.8 | 1060 | 1750 | 1014 |
| Dist A1 | Yes, 50% | 1042 | 988 | 1750 | 1014 |
| Dist A2 | Yes, 50% | 3273 | 3107 | 5153 | 2987 |
| Dist B1 | Yes, 80% | 1042 | 988 | 1750 | 1014 |
| Dist B2 | Yes, 80% | 3119 | 2960 | 4917 | 2850 |
| Ext C0 | No | 378 | 12.3 | — | 296.8 |
| Ext C1 | Yes, 50% | 268 | 29 | — | 297 |
| Ext C2 | Yes, 50% | 726 | 12.7 | — | 815 |
| Ext D1 | Yes, 80% | 266 | 23.2 | — | 297 |
| Ext D2 | Yes, 80% | 793 | 12 | — | 895 |

It will be obvious to a person skilled in the art that, as the technology advances, the inventive concept can be implemented in various ways. The invention and its embodiments are not limited to the examples described above but may vary within the scope of the claims.

The invention claimed is:

1. A method of producing hydrocarbons from a recycled or renewable organic material wherein the recycled or renewable organic material contains hydroxyaromatic hydrocarbon compounds, the method comprising:

(a) providing recycled or renewable organic material;

(b) optionally purifying the recycled or renewable organic material;

(c) hydrotreating the recycled or renewable organic material in a presence of a hydrotreating catalyst, thereby forming a hydrocarbon stream and a phenol-containing effluent;

(d) separating phenols from the phenol-containing effluent of step (c), by liquid-liquid extraction with a non-aromatic organic solvent that is sparingly soluble to water or by stripping, thereby forming a phenol stream and a purified water stream; and (e) recycling the phenol stream obtained in step (d) to step (c) to increase a yield of hydrocarbons obtained from step (c);

to obtain hydrocarbons containing less than 1 wt % oxygen, wherein the recycled or renewable organic material includes at least one or more of crude tall oil (CTO) and its derivatives; tall oil pitch (TOP), tall oil fatty acid (TOFA), distilled tall oil (DTO) and crude fatty acid (CFA); sterol containing fats, and/or animal fats.

2. A method as claimed in claim 1, wherein the recycled or renewable organic material is selected to contain more than 0.01 wt % hydroxyaromatic hydrocarbon compounds.

3. A method as claimed in claim 1, wherein the hydroxyaromatic hydrocarbon compounds are selected from among plant based hydroxyaromatic hydrocarbon compounds, sterols and/or lignin and/or animal fat based compounds, and sterols.

4. A method as claimed in claim 1, wherein step (b) is accomplished by heat treating the recycled or renewable organic material.

5. A method as claimed in claim 1, wherein step (b) is accomplished by bleaching the recycled or renewable organic material.

6. A method as claimed in claim 5, wherein hydrotreating step (c) takes place under continuous hydrogen flow.

7. A method as claimed in claim 6, wherein in step (c) the continuous hydrogen flow has an H2/feed ratio selected to be from 500 to 2000 n-L/L.

8. A method as claimed in claim 1, wherein step (c) is performed at a temperature selected to be from 270 to 380° C.

9. A method as claimed in claim 1, wherein step (c) is performed under pressure from 4 to 20 MPa.

10. A method as claimed in claim 1, wherein the hydrotreating catalyst in step (c) includes at least one component selected from IUPAC group 6, 8 or 10 of the Periodic Table.

11. A method as claimed in claim 1, wherein the hydrotreating catalyst in step (c) is a supported Pd, Pt, Ni, NiW, NiMo or a CoMo catalysts and the support is zeolite, zeolite-alumina, alumina and/or silica, $NiW/Al_2O_3$, $NiMo/Al_2O_3$ or $CoMo/Al_2O_3$.

12. A method as claimed in claim 1, wherein step (c) is accomplished by (c1) hydrodeoxygenating (HDO) the recycled or renewable organic material.

13. A method as claimed in claim 12, wherein in step (c1) the HDO catalyst is sulphided NiW, NiMO or COMO catalyst.

14. A method as claimed in claim 12, wherein HDO is performed at a temperature from 290 to 350° C. under pressure from 4 to 20 MPa and under continuous hydrogen flow.

15. A method as claimed in claim 1, wherein a part of the hydrotreated product is recycled in step (c).

16. A method as claimed in claim 15, wherein a ratio of fresh feed to the hydrotreated product is from 2:1 to 20:1.

17. A method as claimed in claim 1, wherein the non-aromatic organic solvent is selected from a group consisting of mesityl oxide, methyl isobutyl ketone, methyl tert-butyl ketone, methyl tert-butyl ether, methyl isopropyl ketone, 3-heptanone, 2-hexanone and mixtures thereof.

18. A process for producing recycled or renewable hydrocarbons, the process comprising:

(x) producing hydrocarbons from a recycled or renewable organic material as claimed in claim 1; and (y) subjecting the hydrocarbons to an oil refinery conversion process, wherein the oil refinery conversion process includes altering a molecular weight of the feed, removal of heteroatoms from the feed, altering a degree of saturation of the feed, rearranging the molecular structure of the feed, or any combination thereof to obtain at least one recycled or renewable hydrocarbon.

19. A process as claimed in claim 18, wherein step (y) is hydrocracking.

20. A process as claimed in claim 19, wherein step (y) is performed in a mild hydrocracking (MHC) refinery unit.

21. A process as claimed in claim 19, wherein step (y) is performed in a presence of a hydrocracking catalyst.

22. A process as claimed in claim 18, wherein step (y) is steamcracking.

23. A process as claimed in claim 18, wherein step (y) is isomerization.

24. A process as claimed in claim 18, wherein step (y) is hydrotreating.

25. A process as claimed in claim 18, wherein step (y) is thermal catalytic cracking.

26. A process as claimed in claim 18, wherein step (y) is fluid catalytic cracking.

* * * * *